United States Patent [19]

Spitalnick

[11] Patent Number: 4,997,230

[45] Date of Patent: Mar. 5, 1991

[54] AIR CONDITIONED CUSHION COVERS

[76] Inventor: Samuel Spitalnick, 6190 Woodlands Blvd., Tamarac, Fla. 33319

[21] Appl. No.: 472,666

[22] Filed: Jan. 30, 1990

[51] Int. Cl.[5] ..... A47C 7/74

[52] U.S. Cl. ..... 297/180; 5/423; 5/469; 98/2.03; 297/453

[58] Field of Search ..... 5/421, 423, 468, 469; 297/180, 453; 296/208; 98/203, 89, DIG. 7

[56] References Cited

U.S. PATENT DOCUMENTS

| | | | |
|---|---|---|---|
| 2,758,532 | 8/1956 | Awe | 297/180 X |
| 2,931,286 | 4/1960 | Fry, Sr. et al. | 297/180 X |
| 2,992,605 | 7/1961 | Thorman et al. | 297/180 X |
| 3,137,523 | 6/1964 | Karner | 297/180 |
| 4,712,832 | 12/1987 | Antolini et al. | 297/180 |

*Primary Examiner*—Peter R. Brown
*Attorney, Agent, or Firm*—Alvin S. Blum

[57] ABSTRACT

A segmented cover assembly for a vehicle seat or a mattress has multiple segments hingedly joined together to fit between cushioning and the body to blow temperature and humidity controlled air through an air permeable front cover to the body surface that normally is applied directly to the cushion. This prevents chilling, heating, and sweat build up. It also may reduce bed sores when applied to a mattress. A connector assembly is applied to the vent of an air conditioner. The connector assembly has a first outlet that replaces the original vent of the air conditioner and a second outlet to which is removably connected a duct that is connected to each segment. Valves selectively control air flow through each segment and the first outlet. Each segment has an air-impermeable rear panel and sides and an air permeable front panel separated from the rear panel by spacer elements that prevent collapse of the space between front and rear panel to ensure free passage of the conditioned air. The assembly is arranged for easy installation and removal without special skills or tools and that does not disturb the original operation of the air conditioner.

11 Claims, 1 Drawing Sheet

AIR CONDITIONED CUSHION COVERS

This invention relates to cushion covers for seats and mattresses and more particularly to devices for providing a flow of conditioned air to the surface of a seat cushion or mattress to enhance the comfort and well being of the user.

BACKGROUND OF THE INVENTION

To ensure the comfort of passengers in motor vehicles, many vehicles are provided with forced air systems that provide heated or cooled air to the interior. However, the passengers are substantially immobile with their backs and thighs pressed against the seat cushions for prolonged periods of time. Consequently, those portions of their anatomy do not benefit from the cooling or heating provided to the more exposed portions of their anatomy. Porous cushion covers made of woven cane that provide an air space between the seat cover and the passenger permit limited air circulation to give some relief. U.S. Pat. No. 3,738,702 issued Jun. 12, 1973 to Jacobs teachs a heat pipe assembly providing heating or cooling to the thermally conductive surfaces in contact with the body. U.S. Pat. No. 4,572,430 issued Feb. 25, 1986 to Takagi et al teaches a vehicle seat that includes a seat rest and back rest with an air conditioning duct connected to each impervious rear panel and having a front panel made of an air pervious assembly. Between front and rear panels is air pervious cushioning material made of specially crimped and bonded fibers. This separates front and rear panels and provides space for free movement of air from duct through front panel. The front panel includes a porous cloth outer layer and an open cell foam inner layer, to provide unobstructed flow of air through the surface.

SUMMARY OF THE INVENTION

It is accordingly an object of the invention to provide a means for cooling and heating the seat of a vehicle that is portable, easily installed or removed with no special modifications of the seats or vehicles, that is inexpensive, easily packed for shipment and storage and that requires no special tools or skills for installation and use.

The air conditioned cushion covers of the invention includes an adapter assembly that is sealably secured to an air outlet of an air conditioning unit. This assembly provides two auxiliary outlets with a separate valve controlling air flow from each one. A first auxiliary outlet provides an air outlet that replaces the original outlet. The second auxiliary outlet terminates in a connector for connecting a flexible hose. A flexible hose assembly removably attaches to the connector and to a connector on each cushion cover segment, with separate flow control for each segment. For cooling a vehicle seat there will generally be a segment for the seat cushion and a segment for the back rest cushion. For a mattress cover there may be multiple segments so that the head, torso and feet may be separately controlled, for example.

Each cushion cover segment includes an impervious rear panel, a pervious front panel separated from the rear panel by spacing means providing a spacing therebetween for the passage of air. Each cushion cover segment includes an air duct connector at one side, so that cooled or heated forced air can flow from the original outlet on the air conditioning outlet, through the duct to the space between front and rear panels and out through the front panel to cool or warm the surface of the body in contact with the cover. The cushion cover is sufficiently resilient that the cushioning effect of the seat cushion ensures comfort to the passenger.

The cushion covers and duct may be unfastened from the adapter assembly and removed, the valve to the second auxiliary outlet closed and the valve to the first auxiliary outlet opened to return the system substantially to its original condition.

These and other features, objects and advantages of the invention will become more apparent when the detailed description is considered in conjunction with the drawings.

DETAILED DESCRIPTION OF PREFERRED EMBODIMENT

Figure 6:
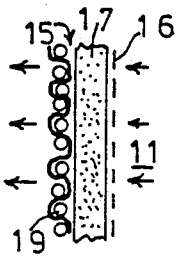
FIG. 6 is a sectional view through a front cover of the invention.
Figure 2:
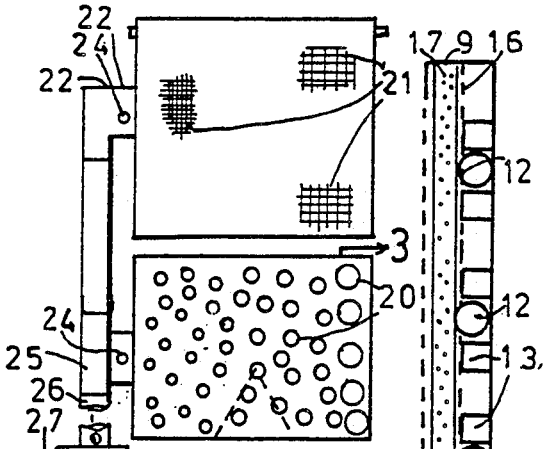
FIG. 2 is a front elevation view of the seat cover.
Figure 3:
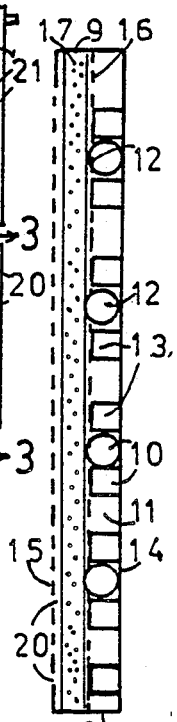
FIG. 3 is a sectional view through line 3—3 of FIG. 2.
Figure 1:
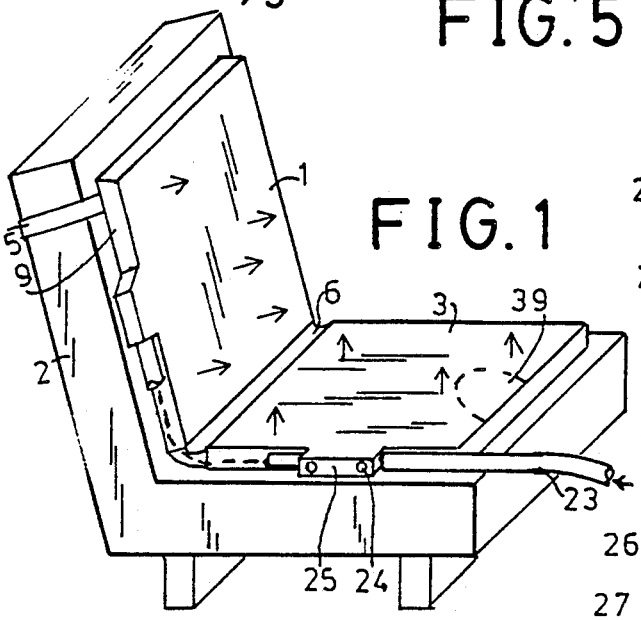
FIG. 1 is a perspective view of a seat cover of the invention in use on a vehicle seat.

Referring now first to FIGS. 1–3, a cushion cover of the invention is shown for use on a vehicle seat. The cover has two segments, a first segment 1 covers the back rest cushion 2 and a second segment 3 covers the seat cushion 4. An elastic strap 5 removably holds the cover in place. The two segments are hinged together by a flexible strip 6. Each segment is composed of a broad, air-impervious rear panel 14, an air-pervious broad front panel 15 spaced apart from the rear panel by an air pervious space 11 having a thickness greater than one-sixteenth inch. The front and rear panels are joined together at their perimeters by air impermeable sides 9. The spacing between front and rear panels is maintained against the forces applied by the body of the user by spacing means 10 within space 11. The spacer means 10 may include wire coils 12, and spaced projections 13 molded into the rear panel 14. The spacer means are such as to permit the free flow of air-conditioned air through the space 11. The front panel 15 may be composed of one or more layers of air permeable, resilient material, such as screen 16, open cell polyurethane foam 17 and woven fabric 19. The air permeability of the front panel may be made non-uniform to ensure equal air flow at regions close and far from the air inlet. The non-uniformity may be achieved by the variable perforations 20 or a variably woven fabric 21. Each space 11 is fed by an air inlet with a connection 22 to an air duct 23. Each air inlet connection 22 is served by a separate valve 24 so that the flow of air to each segment can be separately controlled. One or more branching connectors 25 are provided so that a single flexible hose 26 may be used to connect all the segments to the supply of conditioned air.

Figure 4:
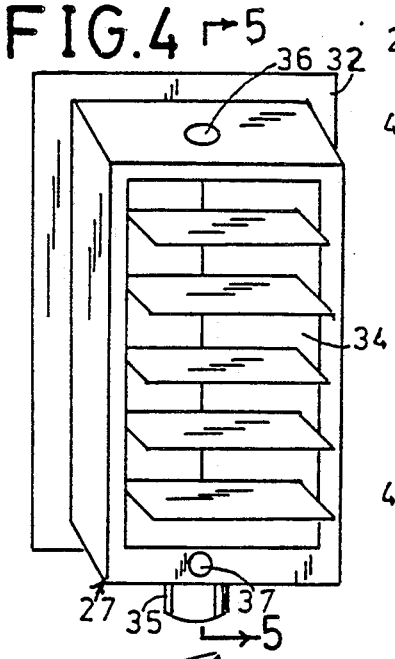
FIG. 4 is a perspective view of the adapter assembly of the invention.
Figure 5:
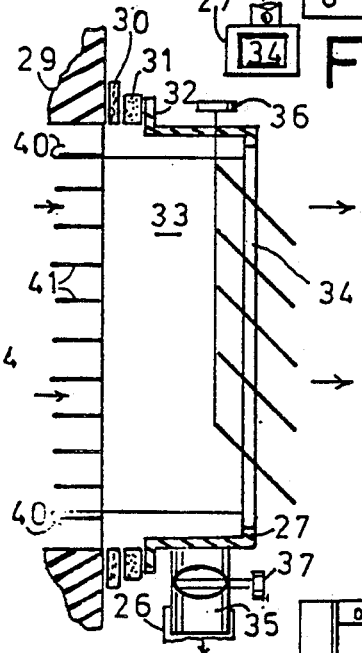
FIG. 5 is a sectional view taken through line 5—5 of FIG. 4.

As best seen in FIGS. 4 and 5, a connector assembly 27 fastens to the front face of the outlet vent 29 of an air conditioning unit in a room or motor vehicle, for example. A pressure sensitive adhesive 30 on a closed-cell resilient foam gasket 31 provides means for making this air-tight seal without special tools. The gasket 31 is permanently affixed to a solid perimeter 32 of the assembly 27 to fit around and frame the air outlet from the air conditioning unit. The air enters plenum chamber 33. There are two outlets from the plenum chamber, the large, louvered direct exit 34, and the duct connector 35. A valve mechanism 36 controls flow out the direct exit 34 and another valve mechanism 37 controls flow out the duct connector 35, so that air flow can be distributed as desired. Connector 35 is arranged to removably connect to flexible duct 26 so that the duct and the segments connected thereto can be conveniently installed or removed without tools or special skills as needed and the removed apparatus may be folded into a small package for storage. The valve 37 may then be closed and valve 36 opened so that the air conditioner is restored substantially to its original condition.

Figure 7:
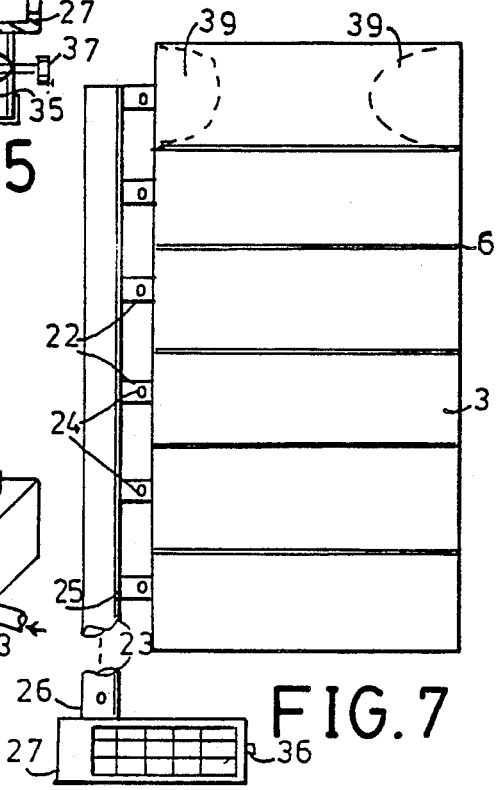
FIG. 7 is a front elevation view of a mattress cover of the invention.

FIG. 7 shows an embodiment of the invention for covering a mattress. Controls may be adjusted so that cooled, warmed, and dry air may be provided beneath the body to provide comfort and also to relieve bed sores for someone confined to bed for long periods. Air input to each segment may be controlled to direct the air to that portion of the body where it will be most effective. Air impervious fabric control flaps 39 may be folded onto the front panel as required to block off air flow to a selected portion of a segment, as required.

As shown in FIG. 5, hooks 40 may be provided to engage louvers 41 to hold adapter 27 in place and prevent closing of louvers 41.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A segmented cushion cover assembly for a cushion such as a vehicle seat or a mattress for connection with a supply of pressurized modified air flowing from an air vent to supply air to a person resting on said cushion, said cover apparatus comprising:

apparatus comprising:

(a) a vent attachment assembly including:

(1) an air chamber having a first opening framed by a flange means;

(2) sealing means for sealably attaching said flange means to the perimeter of said air vent in air-tight relationship;

(3) a second opening in said air chamber opposed to said first opening and arranged to provide an air outlet functioning as a substitute for said air vent, said second opening provided with a first valve means for controlling the flow of air therethrough;

(4) a third opening in said air chamber provided with duct attaching means for connecting an air duct and a second valve means for controlling the flow of air therethrough;

(b) a segmented cushion cover having at least two segments, said segments hingedly connected together along one edge and each segment comprising:

(1) a broad air-impervious rear panel;

(2) a broad air-pervious front panel;

(3) air-impervious narrow sides joining said rear and front panels together to define a broad, thin internal space having a thickness greater than one-sixteenth inch and pervious to air through a broad front face;

(4) air-pervious spacing means contained within said internal space, said spacing means for holding said front panel spaced apart from said rear panel against a closing forces of the body resting on said cushion;

(5) duct connecting means for operatively connecting said internal space to an air duct; and (c) air duct means for connecting said duct attaching means of said said vent attachment assembly to said duct connecting means of each segment.

2. The cushion cover assembly according to claim 1 including individual valve means operatively connected to each segment for selectively controlling the flow of air to each segment.

3. The cushion cover assembly according to claim 1 including air-impervious flap means arranged to be removably applied to portions of said front panel to selectively block the flow of air through areas of said front panel.

4. The cushion cover assembly according to claim 1 in which said spacing means includes projections connected to said rear panel and extending into said internal space.

5. The cushion cover assembly according to claim 4 in which said rear panel is a thin sheet that is formed to provide said projections.

6. The cushion cover assembly according to claim 4 in which said spacing means includes resilient wire coils.

7. The cushion cover assembly according to claim 1 in which said spacing means includes resilient wire coils.

8. The cushion cover assembly according to claim 1 in which said front panel is constructed with reduced air permeability in that area close to said duct connecting means and increased air permeability in those areas remote from said connecting means to equalize the flow of air through said front panel.

9. The cushion cover assembly according to claim 8 in which variable permeability of said front cover is provided by a fabric woven with variable density.

10. The cushion cover assembly according to claim 8 in which variable permeability of said front cover is provided by a membrane with perforations of variable sizes.

11. The cushion cover assembly according to claim 8 in which variable permeability is provided by a membrane with perforations of variable density.

* * * * *